United States Patent [19]

Sanford et al.

[11] Patent Number: 4,768,590

[45] Date of Patent: Sep. 6, 1988

[54] INFLATABLE WELL PACKER

[75] Inventors: Lawrence Sanford, Houston; Charles O. Stokley, Sugar Land, both of Tex.

[73] Assignee: TAM International, Inc., Houston, Tex.

[21] Appl. No.: 891,445

[22] Filed: Jul. 29, 1986

[51] Int. Cl.[4] ..... E21B 33/127

[52] U.S. Cl. ..... 166/187; 277/34

[58] Field of Search ..... 166/187, 120, 122, 195, 166/212; 277/34, 34.6

[56] References Cited

U.S. PATENT DOCUMENTS

| | | | |
|---|---|---|---|
| 2,778,432 | 1/1957 | Allen | 277/34 X |
| 3,050,118 | 8/1962 | Elkins | 166/187 X |
| 3,529,667 | 9/1970 | Malone | 166/187 X |
| 3,542,127 | 11/1970 | Malone | 166/187 X |
| 4,349,204 | 9/1982 | Malone | 166/187 X |
| 4,406,461 | 9/1983 | McGill | 166/187 X |
| 4,424,861 | 1/1984 | Carter, Jr. et al. | 166/187 X |

*Primary Examiner*—Jerome Massie
*Assistant Examiner*—David J. Bagnell
*Attorney, Agent, or Firm*—Browning, Bushman, Zamecki & Anderson

[57] ABSTRACT

An inflatable packer for sealing across downhole conduits comprises a pair of rigid tubular packer heads coaxially interconnected by an inflatable tubular packer body. A bladder in the form of an elongate, flexible elastomeric sleeve includes a central section lining the packer body and having an outer diameter which, in a relaxed state of the bladder, is less than the deflated inner diameter of the packer body. The central section of the bladder is folded upon itself within the packer body in its deflated configuration. An inner reinforcing layer of the packer body is exposed in an annular area between the ends of the packer body.

14 Claims, 2 Drawing Sheets

FIG. 1
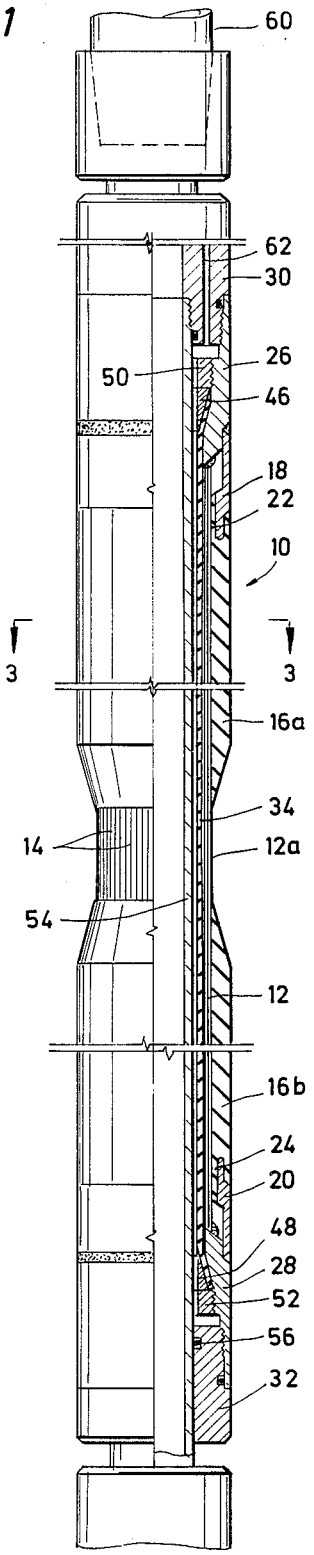
FIG. 2
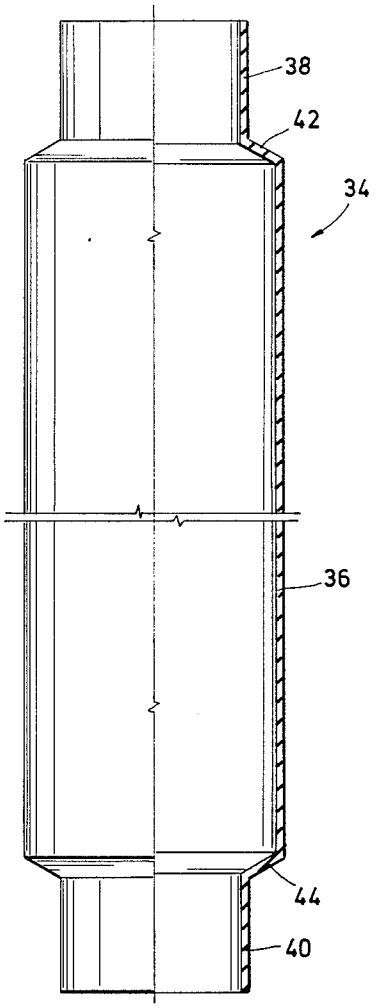
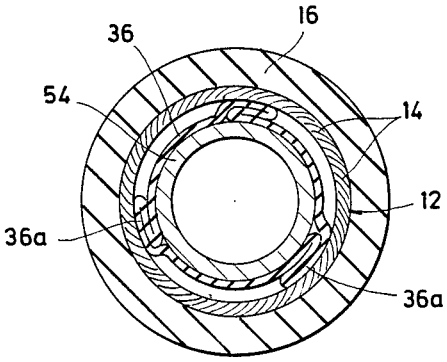
FIG. 3

FIG. 4
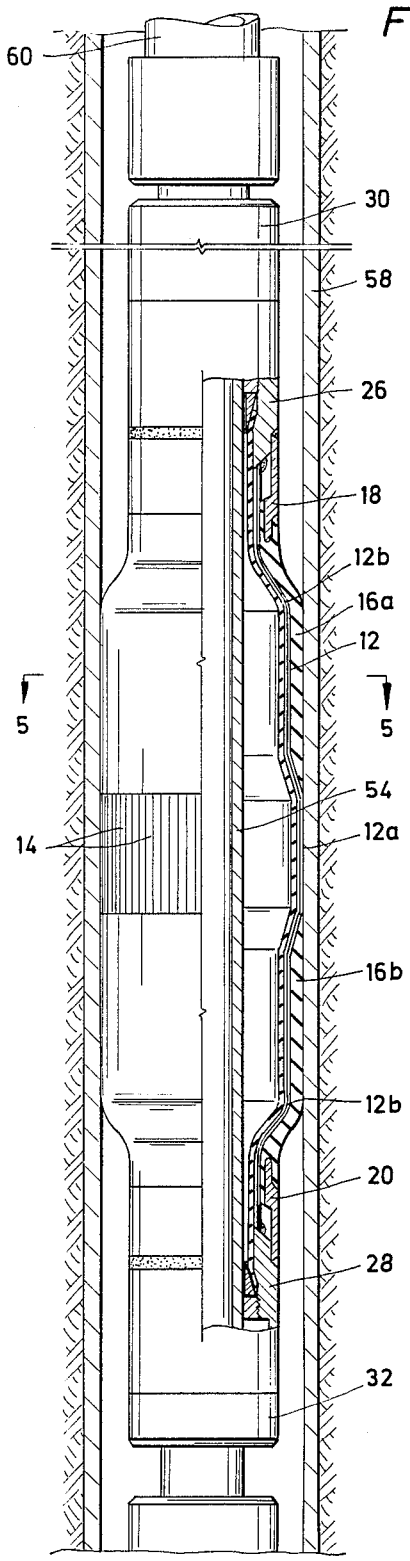
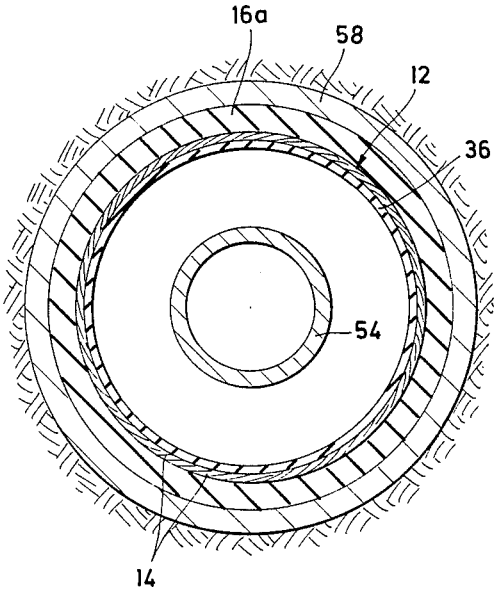
FIG. 5
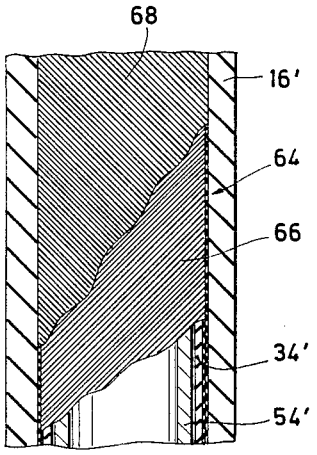
FIG. 6

INFLATABLE WELL PACKER

BACKGROUND OF THE INVENTION

The present invention pertains to inflatable packers which are used to seal across downhole conduits, such as well casings. A typical inflatable packer includes a tubular, inflatable packer body which usually has an outer elastomeric layer and an inner reinforcing layer of flexible but non-elastomeric material, e.g. braided metal cords. Rigid tubular packer heads are coaxially connected to respective opposite ends of the packer body. A tubular mandrel is disposed within the packer heads and packer body. Usually, the upper head is fixed with respect to the mandrel, while the lower head may be longitudinally slidable thereon, to accommodate radial expansion when the packer is inflated.

Although the packer body comprises an elastomeric layer, it is the elastomeric sleeve-like bladder, positioned between the packer body and the mandrel, which actually defines the chamber into which fluid is pumped to inflate the packer, and which retains that fluid. The upper packer head typically includes passageways or other means for introducing inflation fluid to the annular space between the mandrel and the bladder and then sealing it closed.

Particular problems are experienced with inflatable packers having high expansion ratios. For example, a packer which must be run into the well through a string of relatively small tubing, and after emerging therefrom, seal against a larger well casing, must sometimes expand from a relaxed outer diameter to a sealing outer diameter by an amount in excess of 200%. Under such conditions, at least two factors may lead to failure of the bladder and consequent leakage of the packer.

The first factor is a function of the limitations on the elongation ability of elastomers. This ability to substantially reduced at the high temperatures experienced downhole, i.e. above about 150° F.. For example, a nitril rubber with elongation characteristics of 700% to failure at ambient temperature will be reduced to 250% at 210° F.

Secondly, as the packer is inflated, particularly when a rather large increase in outer diameter is effected, the metallic or other members making up the reinforcing layer of tha packer body tend to separate and form gaps in that layer. Meanwhile, the expanding bladder is becoming thinner and thinner, and tends to extrude through any such gaps. This is a particular problem near the packer heads where the packer body must form corners as it is inflated. Again, any portions of the bladder extruding through such gaps may fail, again allowing the packer to leak.

The two problems discussed above also tend to aggravate each other. For example, a portion of a bladder extruding through a gap in the reinforcing layer of the packer body is more likely to fail under high elongation conditions, as described above, and particularly at high temperatures.

Furthermore, these problems often do not occur immediately after inflation of a packer, but rather, after it has been inflated and in use for some time. This has been shown by tests of conventional packers tested in boiling water. Such packers may withstand the test for as much as two or three hours. In the past, one might have conducted such a test, assumed tha packer was reliable, and placed it in use, only to find that it would fail after a longer period of time.

SUMMARY OF THE INVENTION

Packers according to the present invention have similarly been tested in boiling water for periods of time comparable to actual packer usage, and have not failed, but, on the contrary, yielded excellent test results.

In a packer according to the present invention, the bladder has a central section, which lines the packer body, and which is oversized with respect to the packer body. That is to say that, in a relaxed (not stretched) state of the bladder, the outer diameter of the bladder is substantially greater than the deflated inner diameter of the packer body. This central section of the bladder is folded upon itself when the packer is deflated. Then, when the packer is inflated, a substantial part of the increase in diameter of the packer body is accommodated by unfolding of the central section of the bladder, and the extent to which the bladder must stretch during inflation is substantially reduced.

More specifically, the bladder further includes a pair of end sections, of smaller diameter than the central section, coaxially adjoined to the central section by respective shoulder sections.

In one referred embodiment, the reinforcing layer of the packer body is comprised of a plurality of elongate strips extending over the length of the packer body and arranged in an overlapping series progressing circumferentially about the packer body. The amount of overlap is predetermined so that, even when the packer is fully inflated, the adjacent strips do not separate and form gaps. Any tendency of the strips to separate irregularly, and thus form such gaps, can be further reduced by one or both of two expedients. First, the amount of overlap between adjacent strips is in excess of that needed to accommodate the desired amount of radial expansion. Secondly, the outer elastomeric layer of the packer body is bonded to the underlying strips, preferably extending over the critical corner areas near the inner ends of the packer heads, and even partially into the packer heads themselves.

In accord with another aspect of the present invention, the outer elastomeric layer of the packer body is interrupted to expose an annular area of the inner reinforcing layer intermediate the ends of the packer body. When the packer is inflated, the reinforcing layer will bulge out in this area and contact the casing, well bore or other conduit, and frictionally resist slippage of the inflated packer in use.

It is a principal object of the present invention to provide an improved bladder for an inflatable packer, the bladder having an oversized central section.

Another object of the present invention is to provide an improved inflatable packer incorporating such a bladder, with the central section of the bladder further being oversized with respect to the packer body, in deflated configuration.

A further object of the present invention is to provide an improved packer body with means for resisting slippage of the packer body in use.

Other objects, features and advantages of the present invention will be made apparent by the following description, the drawings and the claims.

BRIEF DESCRIPTION OF THE DRAWINGS

FIG. 1 is a quarter sectional view of a packer in accord with the present invention in deflated configuration.

FIG. 2 is a quarter sectional view of the bladder of the packer of FIG. 1 in a relaxed state.

FIG. 3 is a transverse cross-sectional view taken on the line 3—3 of FIG. 1.

FIG. 4 is a longitudinal view, partly in section, of the packer of FIG. 1 in inflated configuration.

FIG. 5 is a transverse cross-sectional view taken on line 5—5 of FIG. 4.

FIG. 6 is a detailed longitudinal sectional view, with parts in elevation, of a modified form of packer body.

DESCRIPTION OF PREFERRED EMBODIMENTS

FIG. 1 shows an inflatable packer according to the present invention comprising a tubular packer body 10. The radially innermost layer 12 of packer body 10 is comprised of a plurality of elongate metal strips 14 extending lengthwise along the packer and arranged in an overlapping series of progressing circumferentially to form a full annular layer (see FIG. 3).

The outermost layer 16 of packer body 10 is comprised of a suitable elastomer. Layer 16 may be described as interrupted, or alternatively, as comprising separate upper and lower portions **16*a* and 16*b*. The interruption in layer 16 exposes an annular gripping area 12*a* of inner layer 12. The outer diameters of portions 16*a* and 16*b* may be tapered adjacent area 12*a*** as shown.

To form the packer body 10, strips 14 are arranged in the overlapping series and held in a suitable fixture or the like. Stepped stress rings 18 and 20 may likewise be held in surrounding but spaced relation to respective ends of layer 12, with the smaller diameter ends of rings 18 and 20 longitudinally innermost. Elastomeric material may then be applied to form layer 16 so that it becomes bonded to the strips 14 and the rings 18 and 20. For example, the material may be cast or molded onto the parts 14, 18 and 20. It is particularly noted that the elastomeric material of layer 16 substantially covers the smaller diameter portions of rings 18 and 20, at least partially filling the annular spaces 22, 24 between those portions and layer 12, so that it is bonded to layer 12 in and adjacent rings 18 and 20.

A sleeve 26 has an annular recess in its lower outer corner in which the free end of ring 18 is fixed, as by welding. The upper ends of strips 14 are welded to the radially inner portion of the lower end of sleeve 26. A sleeve 28, which is a mirror image of the sleeve 26, is similarly affixed to ring 20 and the lower ends of strips 14.

A sub 30 has its lower end threaded into sleeve 26 and sealed with respect thereto. Together, sub 30, sleeve 26 and ring 18 comprise the upper packer head. A sub 32 is similarly threaded into sleeve 28 to form, along with ring 20, the lower packer head.

The packer further comprises a bladder 34 in the form of a monolithic elastomeric sleeve. Bladder 34 is shown in a relaxed state in FIG. 2. By this is meant that the bladder is opened out, but not stretched. As best seen in this relaxed state, the bladder 34, which is monolithic and of generally uniform well thickness, has a long central section 36 of relatively large inner and outer diameters, upper and lower end sections 38 and 40, of smaller inner and outer diameters, and shoulder sections 42 and 44 coaxially connecting respective end sections 38 and 40 to the upper and lower ends of central section 36. Shoulder sections 42 and 44 are radially and longitudinally inclined, for a purpose to be described below.

In the assembled packer, central section 36 of bladder 34 lines the packer body 10, with end sections 38 and 40 extending into the upper and lower packer heads respectively. Shoulder sections 42 and 44 are located just axially inwardly of respective stress rings 18 and 20. Respective ends of sections 38 and 40 are sealingly clamped against inclined surfaces in sleeves 26 and 28 by wedge rings 46 and 48, which in turn are held in place by nuts 50 and 52 threaded into sleeves 26 and 28.

Central section 36 of bladder 34 is oversized with respect to packer body 10 in its deflated configuration, i.e. the relaxed outer diameter of section 36 is greater than the deflated inner diameter of body 10. When the packer is deflated, section 36 is folded upon itself, as shown at **36*a* in FIG. 3, and releasably held in such configuration by being constrained between the deflated packer body 10 and a tubular mandrel 54. Mandrel 54 is threaded into sub 30 and extends through packer body 10 and lower head 32, 28, 20. The lower packer head is longitudinally slidable on mandrel 54 and sealed with respect thereto at 56**.

The packer can be assembled in any convenient manner. For example, the packer body 10 may be formed and affixed to the rings 18 and 20 and to the sleeves 26 and 28, as described above. Meanwhile, the bladder 34 may be placed over the mandrel 54. The central section 36 of the bladder would be folded upon itself and, if necessary, temporarily held in the folded configuration by some removable means such as tape. The mandrel, with the bladder folded thereabout, would then be inserted into the packer body 10. The tape or other means temporarily holding the bladder in its folded condition could be removed, and ring 46 and nut 50 could be installed. Next, sub 30 could be threadedly connected to mandrel 54, and then to sleeve 26. The lower end of the packer could be completed in a similar manner, installing ring 48 and nut 52, then sliding sub 32 over the lower end of the mandrel and threading it into sleeve 28.

FIGS. 4 and 5 show the packer after it has been run into a well casing 58 on an operating string 60 and inflated to engage the casing. Referring back to FIG. 1, it will be seen that sub 30 has a lengthwise bore 62 into which fluid from the interior of the operating string 60 can be introduced, e.g. through a well known valve mechanism (not shown). From passageway 62, the fluid can flow past the inner diameters of nut 50 and ring 46 into the space between mandrel 54 and bladder 34 to inflate the bladder and packer body as shown in FIG. 4. The upper packer head typically has a mechanism, including the aforementioned valve, for then sealing the inflation fluid in that annular space or chamber so that the packer remains inflated without the need to maintain pressure in operating string 60. Many such mechanisms are well known in the art, and therefore the details thereof are not described herein.

Referring to FIG. 5, it will be seen that, during inflation of the packer, the central section 36 of bladder 34 unfolds to lie flush against the reinforcing layer 12 of the packer body. Thus, the bladder can accommodate a substantial amount of radial expansion without any stretching. Then, even if some additional stretching of the bladder is required to inflate to the maximum intended diameter, that amount of stretching will be relatively small and unlikely to cause elongation problems.

Meanwhile, radial expansion of the packer body, and especially of the inner reinforcing layer 12, is possible, even though the strips 14 are not, per se, elastomeric, due to the fact that the lower packer head 32, 28, 20 can slide upwardly on mandrel 54 as the packer body expands, and also to the fact that strips 14 can slide circumferentially relative to one another, decreasing the amount of overlap. However, the initial amount of overlap (FIG. 3) is predetermined to exceed that necessary to accommodate the maximum intended inflated diameter without separation between adjacent strips 14, even in the critical corner areas **12*b* which form near the packer heads as the packer body inflates. The fact that the shoulder sections 42 and 44 of bladder 34 are generally aligned with the parts of layer 12 between shoulders 12*b* and respective stress rings 18 and 20** also helps to prevent the bladder from being unduly stretched or thinned in these areas since the relaxed bladder more nearly matches the inflated configuration of the packer body.

Uneven separation or spreading of the strips 14, and consequent opening of gaps through which bladder 34 could extrude, is further inhibited by the fact that the outer layer 16 of the packer body is bonded to the strips 14, especially in the critical areas beginning at shoulders **12*b* and extending into the stress rings 18 and 20**.

The various factors described above work together to prevent failures in bladder 34. These factors have been found so effective that they prevent bladder failures, at high temperatures at least equal to those encountered downhole, and for long periods of time likewise comparable to actual packer use, and even when the packer diameter is increased by 200% during inflation. Thus, packers according to the present invention can be designed for a very large expansion ratio. For example, such a packer can be built with a small deflated profile, so that it can be run into a well through a string of tubing and then expanded to seal across the well casing, which is much larger in diameter than the tubing.

FIG. 4 also shows that in the exposed annular area **12*a*, the reinforcing layer 12 has further explained to bring the metal strips 14 into contact with the well casing 58**. This frictional engagement with the casing is highly effective in preventing slippage of the inflated packer in the well.

Other types of reinforcing layers may be used in packers according to the present invention. It is desirble that the layers be designed to minimize or eliminate the formation of gaps or windows in the inflated configuration through which the bladder could extrude. By way of example only, FIG. 6 shows another type of reinforcing layer 64 disposed inwardly of and bonded to an outer elastomeric layer 16' of a packer body. A bladder 34' lines the layer 64, and a mandrel 54' lies inwardly of bladder 34'.

More specifically, the layer 64 is comprised of a large number of very small diameter cords, wires, or the like, e.g. of a size on the order of tire cord. As shown, layer 64 is comprised of several sublayers. A first sublayer 66 comprises a number of such cords arranged in one direction in a spiral, and a second sublayer 68, overlapping sublayer 66, has its cords arranged in a reverse spiral.

In other embodiments, the cords might be woven or braided together. In any event, the very large number of relatively small cords substantially eliminates the possibility of the formation of any gaps large enough for the underlying bladder 34' to extrude when the bladder is inflated. Such cords could likewise serve as frictional slippage preventing function, similar to that of area **12*a*** of the first embodiment, if similarly exposed intermediate the ends of the packer body.

Numerous other modifications and variations of the present invention are possible within the skill of the art. Accordingly, it is intended that the scope of the invention be limited only by the claims which follow.

What is claimed is:

1. An inflatable type packer for sealing across downhole conduits comprising:

a pair of rigid tubular packer heads;

an inflatable tubular packer body disposed between said packer heads and coaxially interconnecting said packer heads;

a bladder in the form of an elongate, flexible, elastomeric sleeve including a central section lining said packer body, a pair of end sections adjacent opposite ends of said central section, each secured within a respective one of said packer heads, and a pair of annular shoulder sections each coaxially connecting a respective one of said end sections to the adjacent end of said central section;

and a rigid tubular mandrel having one end rigidly secured within one of said packer heads, extending coaxially through said packer body and into the other of said packer heads radially inwardly of said bladder;

wherein said packer has a fully assembled but deflated configuration wherein said central section of said bladder has a first outer diameter which is greater than the inner diameter of said packer body, said central section of said bladder being folded upon itself between said packer body and said mandrel, and in which said end sections of said bladder have a second outer diameter less than said first outer diameter;

and wherein said one packer head defines passage means for introducing fluid to the area between said mandrel and said bladder.

2. A packer according to claim 1 wherein said bladder is monolithic and has a generally uniform wall thickness.

3. A packer according to claim 2 wherein said shoulder sections, in a relaxed state of said bladder, are radially and longitudinally inclined and are disposed adjacent and axially inwardly of the respective packer heads.

4. A packer according to claim 1 wherein said other packer head is mounted for longitudinal sliding movement on said mandrel.

5. A packer according to claim 4 wherein said packer body includes a radially outer layer of elastomeric material and a radially inner layer of reinforcing material.

6. A packer according to claim 5 wherein said outer layer is interrupted so as to expose an annular section of said inner layer intermediate the ends of said packer body.

7. A packer according to claim 6 wherein said inner layer is an innermost layer disposed immediately adjacent said bladder.

8. A packer according to claim 5 wherein said inner layer comprises a plurality of elongate strips extending along the length of said packer body and arranged in an overlapping series progressing circumferentially about said packer body.

9. A packer according to claim 8 wherein said elastomeric material of said outer layer is bonded to said inner layer.

10. A packer according to claim 9 wherein said inner layer has end portions disposed at least partially within the respective packer heads, and said outer layer extends over and is bonded to portions of said inner layer disposed immediately adjacent but outside of said packer heads.

11. A packer according to claim 10 wherein said outer layer extends at least partially into said packer heads between said packer heads and the end portions of said inner layer disposed therein.

12. A packer according to claim 11 wherein said packer body has a maximum intended inflated diameter, said strips in said inner layer being adapted to slide circumferentially with respect to one another, thereby decreasing the amount of overlap, to permit radial expansion of said packer body to said maximum diameter, and wherein the amount of overlap between said strips in said deflated configuration is substantially greate than the amount needed to accommodate such radial expansion to said maximum diameter.

13. A packer according to claim 5 wherein said packer body has a maximum intended inflated diameter, said strips in said inner layer being adapted to slide circumferentially with respect to one another, thereby decreasing the amount of overlap, to permit radial expansion of said packer body to said maximum diameter, and wherein the amount of overlap between said strips in said deflated configuration is substantially greater than the amount needed to accommodate such radial expansion to said maximum diameter.

14. An inflatable type packer for sealing across downhole conduits comprising:

a pair of rigid tubular packer heads;

an inflatable tubular packer body disposed between said packer heads and coaxially interconnecting said packer heads;

a rigid tubular mandrel having one end rigidly secured within one of said packer heads, extending coaxially through said packer body and into the other of said packer heads; and a tubular bladder having a central section disposed generally coaxially between said packer body and said mandrel;

said packer having a fully assembled but deflated configuration wherein said central section of said bladder is folded upon itself.

* * * * *